US009995467B2

(12) United States Patent
Ho

(10) Patent No.: US 9,995,467 B2
(45) Date of Patent: Jun. 12, 2018

(54) LIGHT-EMITTING DEVICE AND MOUNT THEREFOR

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 177 days.

(21) Appl. No.: 14/759,070

(22) PCT Filed: Jan. 2, 2014

(86) PCT No.: PCT/IB2014/000608
§ 371 (c)(1),
(2) Date: Apr. 15, 2016

(87) PCT Pub. No.: WO2014/132126
PCT Pub. Date: Sep. 4, 2014

(65) Prior Publication Data

US 2017/0003004 A1 Jan. 5, 2017

(30) Foreign Application Priority Data

Jan. 2, 2013 (TW) ..... 102200013 U

(51) Int. Cl.
*F21V 19/00* (2006.01)
*F21V 29/00* (2015.01)
(Continued)

(52) U.S. Cl.
CPC ..... *F21V 19/004* (2013.01); *F21V 29/70* (2015.01); *F21Y 2115/10* (2016.08)

(58) Field of Classification Search
CPC ..... F21V 19/0025; F21V 19/004; F21V 19/0045; F21K 9/20
See application file for complete search history.

(56) References Cited

U.S. PATENT DOCUMENTS 8,834,194 B2 * 9/2014 Sakai ..... F21V 29/22 439/345
9,146,027 B2 * 9/2015 Zantout ..... F21V 21/088
(Continued)

FOREIGN PATENT DOCUMENTS

JP 2010-097926 A 4/2010

*Primary Examiner* — Alan Cariaso
(74) *Attorney, Agent, or Firm* — James A. O'Malley

(57) ABSTRACT

A light emitting device and a holder thereof are provided, the light emitting device comprises a light emitting module, a holder, and a heat dissipate member formed with fastening holes in a surface thereof. The light emitting module comprises a substrate, a light emitting package, and at least two contact pads. The holder comprises a body, a bracket, at least two terminals pressed against the corresponding contact pads, and at least two latching members. The body has a top surface, a bottom surface, and a receiving opening and a plurality of fixing holes which penetrate through the top surface and the bottom surface. The receiving opening comprises an upper opening and a lower opening formed in the bottom surface of the body. The bracket is connected with the body and provided to the receiving opening for the light emitting module to abut against. By that the latching members are provided alongside the lower opening of the bottom surface of the body, when the light emitting module is assembled into the receiving opening, the latching members completely latch and fix the substrate into the receiving opening, so as to make the light emitting module not easily disengaged from the holder before the whole assembling is completed.

18 Claims, 4 Drawing Sheets

(51) Int. Cl.
*F21V 29/70* (2015.01)
*F21Y 115/10* (2016.01)

(56) References Cited

U.S. PATENT DOCUMENTS

| | | | | |
|---|---|---|---|---|
| 2009/0207617 | A1 | 8/2009 | Merchant et al. | |
| 2012/0099328 | A1 | 4/2012 | Miyashita et al. | |
| 2013/0070464 | A1* | 3/2013 | Shinohara | F21V 3/00 362/373 |
| 2013/0084748 | A1 | 4/2013 | Zaderej et al. | |
| 2014/0063814 | A1* | 3/2014 | McGowan | F21V 7/00 362/308 |
| 2015/0131299 | A1 | 5/2015 | Meyer et al. | |

* cited by examiner

LIGHT-EMITTING DEVICE AND MOUNT THEREFOR

DESCRIPTION OF THE PRESENT DISCLOSURE

Field of the Present Disclosure

The present disclosure relates to a light emitting device having a light emitting diode (LED), and specifically relates to a holder for mounting a light emitting diode module and a light emitting device comprising the holder.

Background of the Present Disclosure

A light emitting device fabricated with a Light Emitting Diode (LED) has advantages of high energy conversion efficiency, a short response time, a long service life and a small volume or the like which are better than a conventional tungsten lamp, therefore it is widely concerned and positively researched and developed by many countries in recent years.

But an existing light emitting device with the light emitting diode typically assembles a light emitting diode array in a holder and then locks the holder to a heat dissipate device so as to make the light emitting diode array clipped via a cooperation of the holder and the heat dissipate device to complete the fixing operation. For example, a Taiwanese patent application No. TW100200669 (corresponding to a PCT Publication number WO 2011/088212 A2, a Chinese patent application No. CN201120042217.0 and a Chinese patent application No. CN201180004948.9) discloses a holder of a light emitting device. A frame of the holder is formed with an inner opening for receiving the light emitting diode array, and the inner opening is provided with a bracket therein. A shoulder comprised in the bracket is used to for the light emitting diode array to securely abut against, and a support protrusion and a second protrusion are engaged with positioning elements of the light emitting diode array for alignment. The frame of the holder, together with the light emitting diode array, can be fixed to the heat dissipate device with a conventional fastening element (for example a screw), thereby completing assembling of the light emitting device.

However, in the holder disclosed in the above patent, although the support protrusion and the second protrusion can be engaged with the positioning elements of the light emitting diode array to assist the alignment operation during assembling, the light emitting diode array can not be completely fixed to the holder. And because the holder has terminals pressing against an upper surface of the light emitting diode array, the light emitting diode array is subjected to a force pushing downwardly, when the holder is not locked to the heat dissipate device by a screw, the light emitting diode array is pushed by the terminals and can not be fixed and fit to the holder, so it is quite easy to make the light emitting diode array disengaged from the inner opening of the holder in the assembling operation.

Moreover, there is not any member which can assist to guide the light emitting diode array into the inner opening when the light emitting diode array is assembled into the inner opening of the holder, so it is not easy to guide the light emitting diode array to be rapidly and accurately engaged with the holder. Moreover, there is not any positioning device between the holder and the heat dissipate device in the prior art, so when the holder and the heat dissipate device need to be mutually locked by the screw, firstly relative positions of the holder and the heat dissipate device are accurately adjusted to make lock holes of them aligned with each other, thereby increasing difficulty of the whole assembling operation and lowering the assembling efficiency.

SUMMARY OF THE PRESENT DISCLOSURE

Hereafter, an object of the present disclosure is to provide a holder for stably and completely fixing a light emitting module thereon.

Another object of the present disclosure is to provide a holder which has an alignment mechanism together with a heat dissipate member.

Another object of the present disclosure is to provide a holder with an effect of guiding the light emitting module to be assembled.

Another object of the present disclosure is to provide a light emitting device which has the above holder.

Therefore, a light emitting device of the present disclosure comprises a light emitting module, a holder for assembling the light emitting module and a heat dissipate member for locking with the holder. The light emitting module comprises a substrate and a light emitting package provided on the substrate. The substrate is provided with at least two contact pads electrically connected to the light emitting package.

The holder comprises a body, a bracket connected with the body, at least two terminals provided to the body, and at least two latching members. The body has a top surface, a bottom surface, and a plurality of fixing holes and a receiving opening which penetrate through the top surface and the bottom surface. The receiving opening comprises an upper opening formed in the top surface and a lower opening formed in the bottom surface for assembling the light emitting module into the receiving opening. The each fixing hole is used for a corresponding cooperative locking member to pass through the holder. The bracket is connected with the body and provided to the receiving opening for the light emitting module to abut against when the light emitting module is assembled into the receiving opening. The each terminal comprises a resilient pressing portion to downwardly press against the corresponding contact pad.

The each latching member is provided alongside the lower opening of the bottom surface of the body, and latch the substrate to completely fix the substrate into the receiving opening when the light emitting module is assembled into the receiving opening. A surface of the heat dissipate member is formed with an receiving hole for receiving the corresponding latching member, and a fastening hole for the corresponding locking member to pass through and lock.

In an embodiment, the holder further comprises at least two positioning posts respectively provided at the bottom surface of the body. The each positioning post has an alignment portion, a shape of which corresponds to a periphery of the substrate for the substrate to be aligned with the receiving opening. The surface of the heat dissipate member is further formed with positioning holes for the positioning posts to pass through and position; when the positioning posts are provided through the positioning holes, positions of the fixing holes of the holder correspond to positions of the fastening holes of the heat dissipate member.

The effects of the present disclosure are: by that the bottom surface of the body of the holder is provided with the latching members, the light emitting module is latched by the latching members and stably and completely fixed to the holder after the light emitting module is assembled into the holder, and does not disengage from the holder before the holder and the heat dissipate member are locked. Moreover, by a design that the holder and the heat dissipate member respectively have the positioning posts and the positioning holes, alignments between the fixing holes and the fastening holes is completed after the positioning posts insert into the positioning holes, an additional operation that the fixing holes and the fastening holes are aligned is omitted, thereby improving the efficiency of assembling process. Moreover, since the positioning post is provided with the alignment portion, and provides a guiding mechanism before the light emitting module is assembled into the receiving opening of the holder, which makes the assembling of the light emitting module and the holder more easier.

DETAILED DESCRIPTION

The foregoing and other technical contents, features and effects of the present disclosure will be apparent through the following detailed description for a specific embodiment in combination with the drawings.

Referring to FIGS. 1-4, a light emitting device of an embodiment of the present disclosure comprises a light emitting module 1, a holder 2 for assembling the light emitting module 1 therein, and a heat dissipate member 3 for locking with the holder 2 to each other. The light emitting module 1 comprises a substrate 11, and a light emitting package 12 provided on the substrate 11 for emitting light. The substrate 11 is provided with two contact pads 111 electrically connected to the light emitting package 12 to transmit an external power to the light emitting package 12. In the embodiment, the light emitting module 1 is a light emitting module packaging a light emitting diode.

The holder 2 comprises a body 21, a bracket 22 connected with the body 21, two terminals 23 provided to the body 21, two positioning posts 24, and two latching members 25. The body 21 has a top surface 211, a bottom surface 212, and two fixing holes 213 and a receiving opening 214 which penetrate through the top surface 211 and the bottom surface 212. The receiving opening 214 is used to receive the light emitting package 12 when the light emitting package 12 is assembled into the holder 2, and comprises an upper opening 215 formed in the top surface 211, and a lower opening 216 formed in the bottom surface 212 for assembling the light emitting module 1 into the receiving opening 214. A shape of the lower opening 216 is a polygon having a plurality of corners, in the embodiment, the shape of the lower opening 216 is a rectangular shape, and a periphery of the substrate 11 of the light emitting module 1 is a rectangular shape corresponding to the shape of the lower opening 216. The two fixing holes 213 are respectively provided for two locking members (not shown) to pass through the holder 2, so as to fix the holder 2 to the heat dissipate member 3 by locking from the locking members. Herein, the locking member can be selected from any member having a locking function, such as a screw, a rivet or a positioning pin or the like.

The bracket 22 is provided to the receiving opening 214, and comprises a shoulder 221 protruding into the receiving opening 214. The shoulder 221 is recessed relative to the bottom surface 212 and is parallel to the bottom surface 212, and is used for the substrate 11 of the light emitting module 1 to fit upwardly and abut against when the substrate 11 of the light emitting module 1 is assembled into the receiving opening 214, so as to limit the light emitting module 1 by the shoulder 221 in a direction that the light emitting module 1 is assembled into the holder 2. The two terminals 23 each comprise a resilient pressing portion 231 extending into the receiving opening 214. The resilient pressing portions 231 press downwardly against the corresponding contact pads 111 of the substrate 11, and transmit the external power to the light emitting package 12 to put the function of lighting of the light emitting package 12 into effect via the electrical connection between the contact pads 111 and the light emitting package 12.

The positioning posts 24 are provided at the bottom surface 212 of the body 21, and are positioned at opposite corners which are adjacent to a periphery of the lower opening 216. The each positioning post 24 has an alignment portion 241, a shape of which corresponds to a periphery of the substrate 11, which assists to guide the substrate 11 to be aligned with the receiving opening 214 when the substrate 11 is assembled into the receiving opening 214. In the embodiment, the positioning posts 24 are cylinders, and the shape of the alignment portion 241 is a right-angle alignment groove formed by cutting away corresponding one-quarter cylinder of the positioning post 24 correspondingly to the corner of the lower opening 216, and the two right-angle alignment grooves are used for two opposite corners of the substrate 11 to pass through and be aligned. It should be noted that, the positioning posts 24 are not necessary positioned at the two opposite corners of the lower opening 216, and they just needs to be positioned at the periphery of the lower opening 216 to form the alignment portions 241 for guiding assembling of the substrate 11. Furthermore, the shape of the alignment portion 241 is not limit to the embodiment, in an equivalent embodiment, the alignment portion 241 may also be a non right-angle notch or protruding block, as long as the shape of the alignment portion 241 correspondingly match the periphery of the substrate 11 to guide the substrate 11 to be smoothly aligned and assembled with the lower opening 216.

The two latching members 25 of the holder 2 are provided at two opposite side edges 217 alongside the lower opening 216 of the bottom surface 212 of the body 21, and are respectively positioned at opposite two sides of a line connecting center points of the two side edges 217, and are respectively adjacent to the two positioning posts 24 but positions thereof are not symmetric. Herein, the latching members 25 each have a resilient arm 251 extending from the body 21 along the side edge 217, and a hook 252 formed at a tip end of the resilient arm 251. When the light emitting module 1 is assembled into the holder 2, two opposite sides of the substrate 11 respectively abut against and push the two hooks 252, which makes the hooks 252 drive the resilient arms 251 to produce elastic deformation and move toward the corresponding side edges 217, thereby making the light emitting module 1 smoothly enter into the receiving opening 214. But after the light emitting module 1 is assembled into the receiving opening 214, the hook 252 returns to its original position by the recovering elastic force of the resilient arm 251, and latches on a bottom surface (see FIG. 5) of the substrate 11 to make the light emitting module 1 limited by the latching member 25 in the direction of disengaging from the receiving opening 214.

By the above mutual cooperation of the latching members 25 and the shoulder 221, the light emitting module 1 is completely fixed in the receiving opening 214, therefore the light emitting module 1 will not disengage from the receiving opening 214 of the holder 2 due to abutting and pressing from the resilient pressing portions 231 of the terminals 23. In the embodiment, the configuration that the positions of the two latching members 25 are not symmetric makes the substrate 11 not easily flip over and disengage from the receiving opening 214 after the substrate 11 is latched by the hooks 252, the fixing effect of the latching member 25 is more stable. Moreover, the two hooks 252 each are formed with a slope 253 at an opposite inner side, which makes the light emitting module 1 suffer a smooth guide when the light emitting module 1 is assembled into the receiving opening 214 and abut against and push the hook 252, and makes the light emitting module 1 more easily enter into the receiving opening 214.

A surface of the heat dissipate member 3 is formed with two positioning holes 31, two receiving holes 32, and two fastening holes 33 for the corresponding locking members to pass through and lock. When the heat dissipate member 3 is engaged with the holder 2, the two positioning posts 24 of the holder 2 are first respectively provided through and limited in the corresponding positioning holes 31 of the heat dissipate member 3, at this time, by the mutual positioning between the positioning posts 24 and the positioning holes 31, positions of the fixing holes 213 of the holder 2 and positions of the fastening holes 33 of the heat dissipate member 3 corresponds to each other, a locking member can easily pass through the fixing hole 213 and the fastening hole 33 at the same time to be securely locked to the heat dissipate member 3, an additional process of making the fixing holes 213 aligned with the fastening holes 33 is not required, thereby improving the convenience of the whole assembling. The two receiving holes 32 of the heat dissipate member 3 are respectively used to receive the latching members 25 of the holder 2. In a modified embodiment, a cooperation of the latching member 25 and the receiving hole 32 can also attain the effect of making the holder 2 pre-positioned on the heat dissipate member 3.

In conclusion, by that the holder 2 is provided with the latching members 25 for latching and fixing the light emitting module 1, the light emitting module 1 will be stably and completely fixed with the holder 2 after the light emitting module 1 is assembled into the holder 2, thereby overcoming the disadvantage of the prior art that the light emitting diode array easily disengages from its holder before the whole assembling is completed. Moreover, the positioning posts 24 of the holder 2 and the positioning holes 31 of the heat dissipate member 3 are mutually engaged and positioned, so after the positioning posts 24 of the holder 2 are inserted into the positioning holes 31, alignments of the fixing holes 213 and the fastening holes 33 would be completed to allow the locking member to smoothly pass through, which does not require an additional process of making the fixing holes 213 aligned with the fastening holes 33, thereby improving efficiency of the whole assembling. Moreover, by that the positioning post 24 is provided with the alignment portion 241, the shape of which is matched with the periphery of the substrate 11 of the light emitting module 1, there is a guiding mechanism when the light emitting module 1 is assembled into the receiving opening 214, and the light emitting module 1 is more easily aligned with and engaged with the receiving opening 214.

What have been described above are only embodiments of the present disclosure, the implementation scope of the present disclosure is not limited to that, that is, simple equivalent variations and modifications made according to the Claims and the description content of the present disclosure are still included in the protective scope of the present disclosure.

BRIEF DESCRIPTION OF THE DRAWINGS OF THE PRESENT DISCLOSURE

DESCRIPTION OF REFERENCE NUMERALS FOR MAIN ELEMENTS

Figure 1:
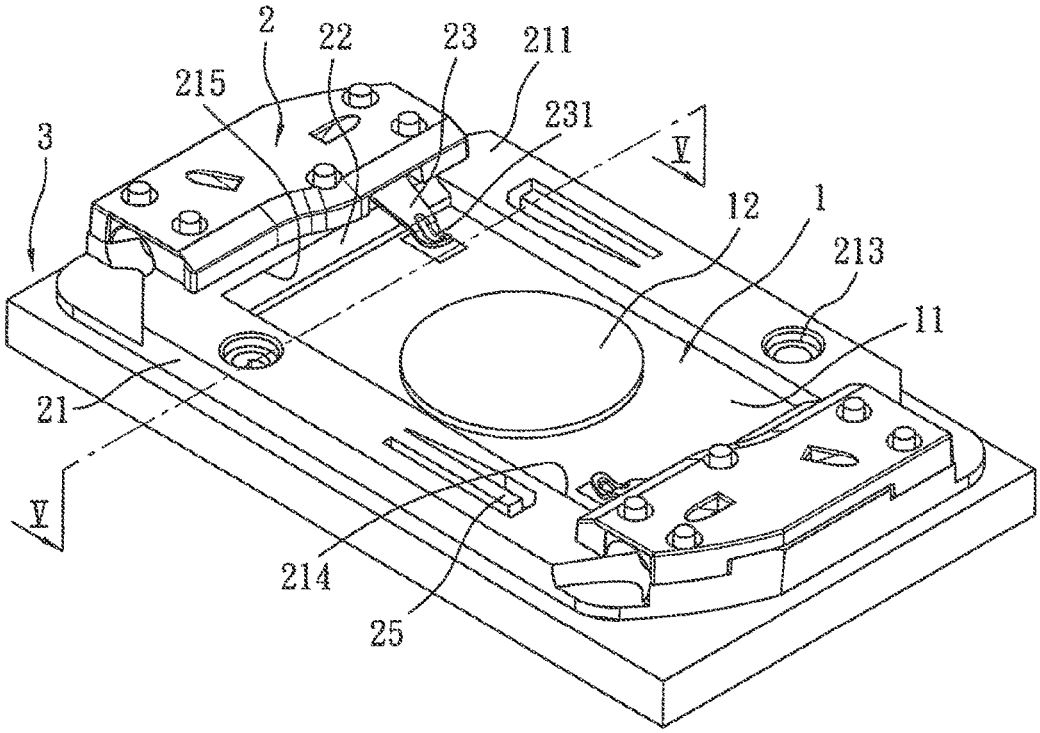
FIG. 1 is a perspective view illustrating a light emitting device of an embodiment of the present disclosure.
Figure 2:
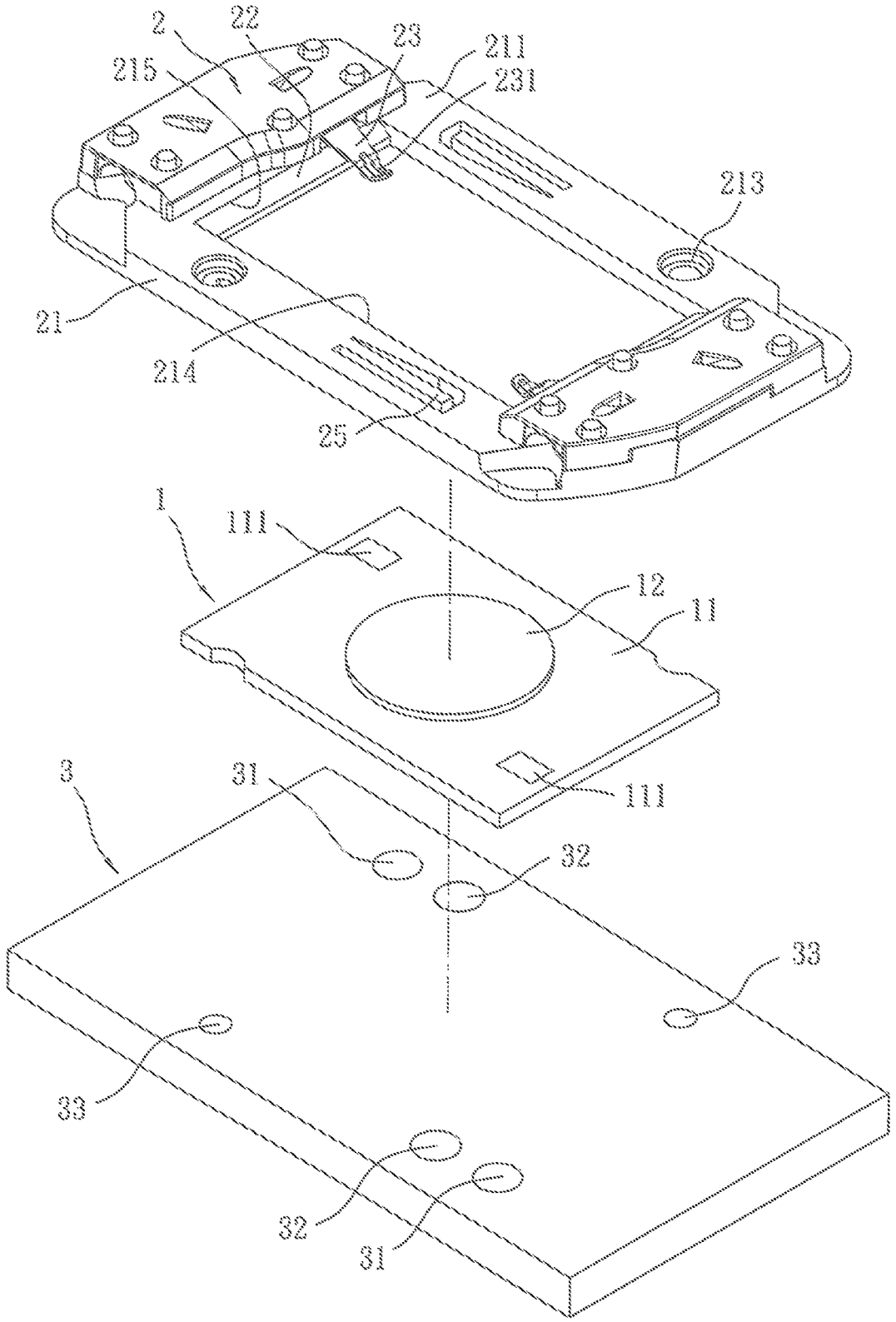
FIG. 2 is an exploded view illustrating constituent members of the embodiment.
Figure 3:
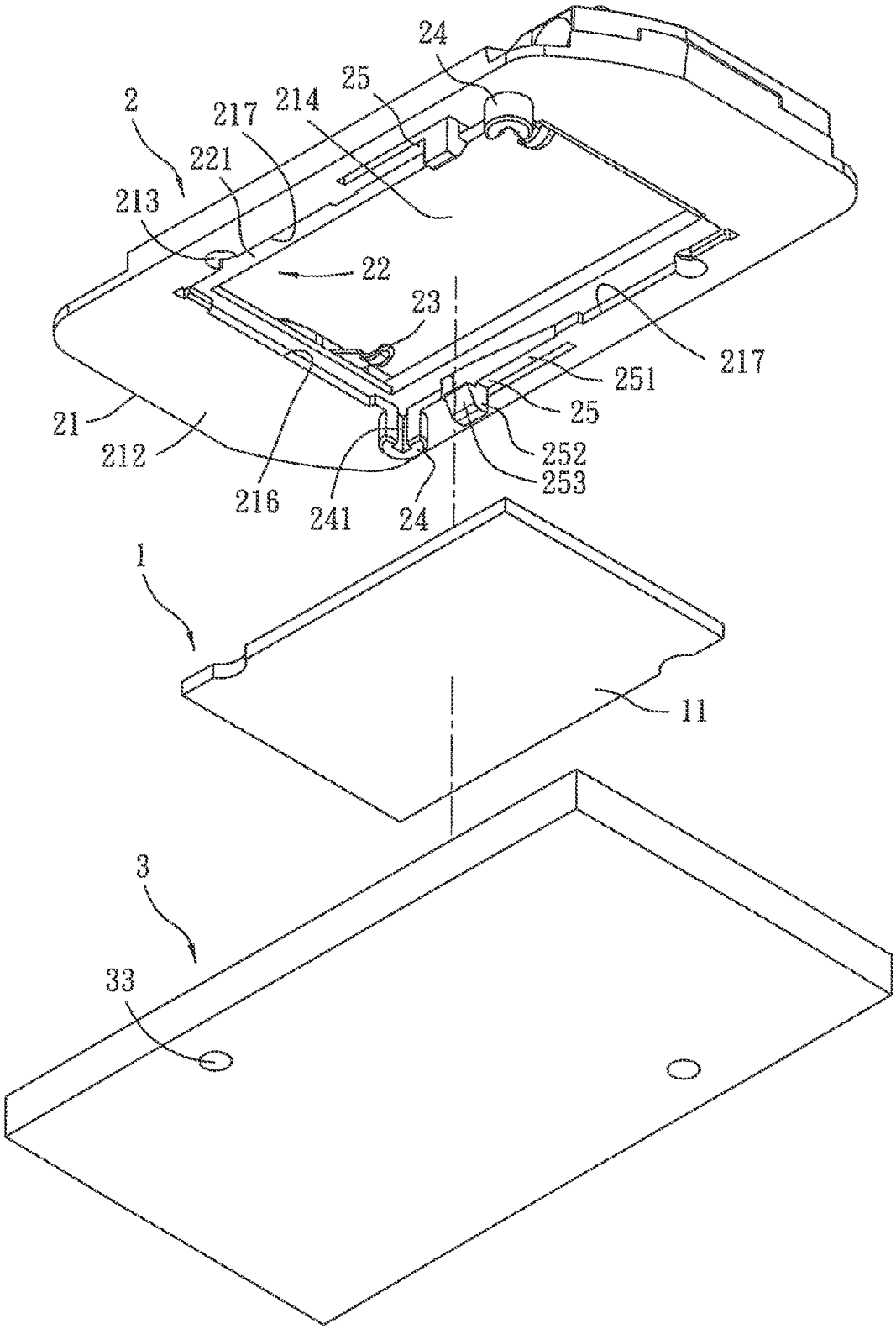
FIG. 3 is an exploded view illustrating constituent members of the embodiment viewed from an angle different from FIG. 2.
Figure 4:
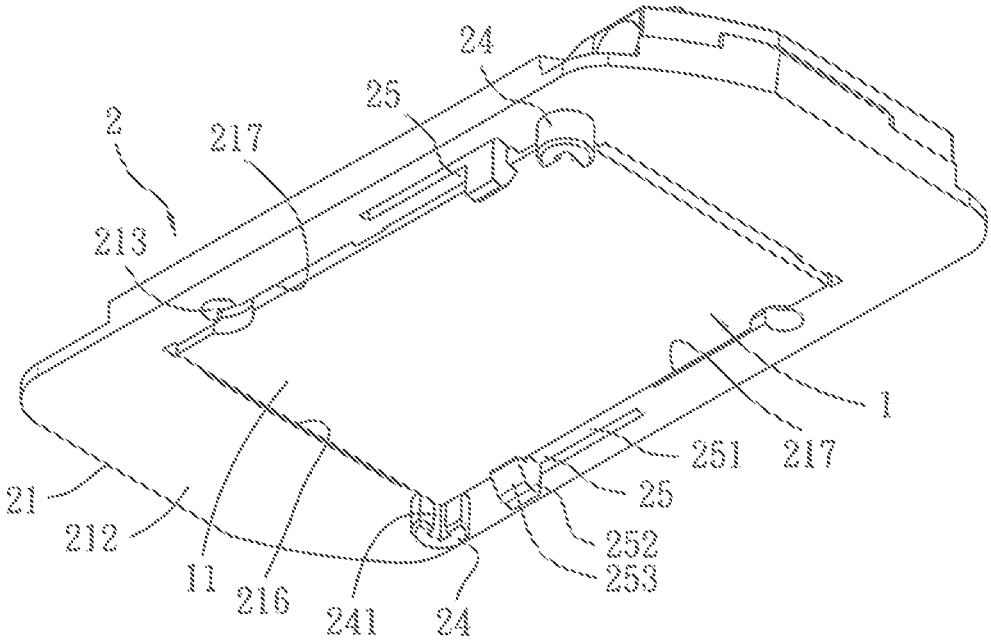
FIG. 4 is an assembled view illustrating an assembled status of the light emitting module and the holder.
Figure 5:
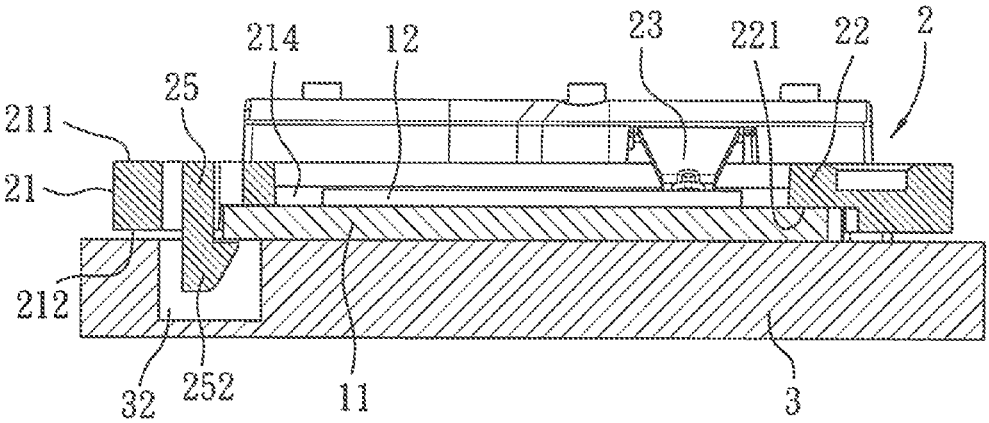
FIG. 5 is a cross-sectional view taken along a line V-V of FIG. 1 illustrating that a latching member latches and fixes the light emitting module.

| | | | |
|---|---|---|---|
| 1 | light emitting module | 221 | shoulder |
| 11 | substrate | 23 | terminal |
| 111 | contact pad | 231 | resilient pressing portion |
| 12 | light emitting package | 24 | positioning post |
| 2 | holder | 241 | alignment portion |
| 21 | body | 25 | latching member |
| 211 | top surface | 251 | resilient arm |
| 212 | bottom surface | 252 | hook |
| 213 | fixing hole | 253 | slope |
| 214 | receiving opening | 3 | heat dissipate member |
| 215 | upper opening | 31 | positioning hole |
| 216 | lower opening | 32 | receiving hole |
| 217 | side edge | 33 | fastening hole |
| 22 | bracket | | |

What is claimed is:

1. A holder, comprising:

a body having a top surface, a bottom surface and a receiving opening penetrating through the top surface and the bottom surface, the receiving opening comprising an upper opening formed in the top surface and a lower opening formed in the bottom surface;

a shoulder connected with the body and protruding into the receiving opening and recessed relative to the bottom surface;

at least two terminals provided to the body and each comprising a resilient pressing portion extending into the receiving opening via the upper opening; and at least two latching members respectively provided alongside the lower opening of the bottom surface of the body.

2. The holder according to claim 1, wherein the holder further comprises at least two positioning posts respectively provided at the bottom surface of the body.

3. The holder according to claim 2, wherein the lower opening has a polygonal shape with a plurality of corners, the at least two positioning posts are respectively positioned at the corners of the lower opening and each have an alignment groove having a shape corresponding to the respective corner of the lower opening and each are formed by cutting.

4. The holder according to claim 3, wherein the lower opening has a rectangular shape with four corners, the at least two positioning posts are cylinders, each alignment groove is a right-angle notch formed by cutting away corresponding one-quarter cylinder of the positioning post correspondingly to a shape of the respective corner of the lower opening.

5. The holder according to claim 2, wherein positions of the at least two latching members are respectively adjacent to the at least two positioning posts.

6. The holder according to claim 1, wherein a tip end of each latching member is formed with a hook.

7. The holder according to claim 6, wherein each latching member further has a resilient arm extending along a side edge of the lower opening.

8. A light emitting device, comprising:

a light emitting module comprising a substrate and a light emitting package provided on the substrate, the substrate being provided with at least two contact pads electrically connected to the light emitting package;

a holder comprising:

a body having a top surface, a bottom surface, and a receiving opening which penetrates through the top surface and the bottom surface, the receiving opening comprising an upper opening formed in the top surface and a lower opening formed in the bottom surface, the receiving opening being provided for assembling the light emitting module into the receiving opening;

a bracket connected with the body, the bracket being configured to allow the light emitting module to abut against the bracket when the light emitting module is assembled into the receiving opening;

at least two terminals provided to the body and each comprising a resilient pressing portion extending into the receiving opening via the upper opening, each resilient pressing portion configured to downwardly press against a corresponding contact pad when the light emitting module is assembled into the receiving opening; and at least two latching members respectively provided alongside the lower opening of the bottom surface of the body and latching and fixing the substrate into the receiving opening when the light emitting module is assembled into the receiving opening; and a heat dissipate member formed with at least two receiving holes in a surface thereof for receiving the corresponding at least two latching members.

9. The light emitting device according to claim 8, wherein a tip end of each latching member is formed with a hook.

10. The light emitting device according to claim 9, wherein each latching member further has a resilient arm extending along a side edge of the lower opening.

11. The light emitting device according to claim 8, wherein the bracket comprises a shoulder protruding into the receiving opening, the shoulder is recessed relative to the bottom surface.

12. The light emitting device according to claim 8, wherein the holder further comprises at least two positioning posts respectively provided at the bottom surface of the body, the surface of the heat dissipate member is further formed with at least two positioning holes for the at least two positioning posts to pass through and position.

13. The light emitting device according to claim 12, wherein each positioning post has an alignment portion, a shape of which corresponds to a periphery of the substrate, for the substrate to be aligned with the receiving opening.

14. The light emitting device according to claim 13, wherein the lower opening has a polygonal shape with a plurality of corners, the at least two positioning posts are positioned at the corners of the lower opening.

15. The light emitting device according to claim 14, wherein the alignment portion of each positioning post is an alignment groove having a shape corresponding to the respective corner of the lower opening and each alignment portion is formed by cutting.

16. The light emitting device according to claim 15, wherein the lower opening has a rectangular shape with four corners, the at least two positioning posts are cylinders, each alignment groove is a right-angle notch formed by cutting away corresponding one-quarter cylinder of the positioning post correspondingly to a shape of the respective corner of the lower opening.

17. The light emitting device according to claim 8, wherein the body has a plurality of fixing holes which penetrate through the top surface and the bottom surface, and wherein the heat dissipate member is formed with fastening holes, and wherein positions of the fixing holes of the holder correspond to positions of the fastening holes of the heat dissipate member to allow for corresponding cooperative locking members to pass through each of the holder and the heat dissipate member.

18. The light emitting device according to claim 17, wherein the holder further comprises at least two positioning posts respectively provided at the bottom surface of the body, the surface of the heat dissipate member is further formed with at least two positioning holes for the at least two positioning posts to pass through and position, wherein when the at least two positioning posts are provided through the at least two positioning holes, positions of the fixing holes of the holder correspond to positions of the fastening holes of the heat dissipate member.

* * * * *